US009372450B2

(12) United States Patent
Kitagawa et al.

(10) Patent No.: US 9,372,450 B2
(45) Date of Patent: Jun. 21, 2016

(54) IMAGE FORMING APPARATUS

(71) Applicant: CANON KABUSHIKI KAISHA, Tokyo (JP)

(72) Inventors: Oki Kitagawa, Nagareyama (JP); Akiyoshi Shinagawa, Kashiwa (JP); Masanobu Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/716,279

(22) Filed: May 19, 2015

(65) Prior Publication Data

US 2015/0338794 A1 Nov. 26, 2015

(30) Foreign Application Priority Data

May 20, 2014 (JP) ..... 2014-104289

(51) Int. Cl.
*G03G 15/20* (2006.01)

(52) U.S. Cl.
CPC ..... *G03G 15/205* (2013.01)

(58) Field of Classification Search
CPC ..... G03G 21/206; G03G 15/2017; G03G 15/2028; G03G 15/2003; G03G 21/203; G03G 15/0194; G03G 15/0258; G03G 15/0865; G03G 15/0867; G03G 15/0872; G03G 15/0894; G03G 15/2007
See application file for complete search history.

(56) References Cited

U.S. PATENT DOCUMENTS 8,131,174 B2 3/2012 Ando
8,208,833 B2 6/2012 Kitagawa
8,554,099 B2 10/2013 Kitagawa
8,655,213 B2 2/2014 Tanaka et al.
8,666,273 B2 3/2014 Tanaka
8,687,997 B2 4/2014 Kurotsu et al.
8,917,999 B2 12/2014 Takada et al.
8,918,003 B2 12/2014 Kawai et al.
8,929,762 B2 1/2015 Shinagawa et al.
8,989,640 B2 3/2015 Kitagawa et al.
9,025,999 B2 5/2015 Kitagawa (Continued)

FOREIGN PATENT DOCUMENTS

JP 2009-210792 9/2009
JP 2010-181468 8/2010

(Continued)

OTHER PUBLICATIONS

Masanobu Tanaka, U.S. Appl. No. 14/717,221, filed May 20, 2015.

*Primary Examiner* — Roy Y Yi
(74) *Attorney, Agent, or Firm* — Fitzpatrick, Cella, Harper & Scinto

(57) ABSTRACT

An image forming apparatus includes: heating and pressing rollers for fixing a toner image; a contacting and spacing portion for contacting and spacing between the rollers; an air feeder for cooling the pressing roller during a job; a guide for the sheet having been subjected to an image fixing process; an acquiring portion for acquiring the temperature of the guide: and an executing portion for executing a warming-up process of the heating roller and the pressing roller to raise the temperatures of the heating roller and the pressing roller. The executing portion controls the contacting and spacing portion and the air feeder so that the air is fed toward the guide through between the heating roller and the pressing roller at least in a part of the warming-up process, when the temperature is lower than a predetermined temperature upon activation of a main voltage source.

9 Claims, 7 Drawing Sheets

(56) References Cited

U.S. PATENT DOCUMENTS

| | | | | |
|---|---|---|---|---|
| 2006/0083536 | A1* | 4/2006 | Shishido | G03G 15/2064 399/92 |
| 2009/0226200 | A1 | 9/2009 | Ando | |
| 2011/0280607 | A1* | 11/2011 | Tanaka | G03G 15/2014 399/67 |
| 2012/0114346 | A1 | 5/2012 | Kurotsu et al. | |
| 2013/0034361 | A1 | 2/2013 | Shinagawa | |
| 2013/0034362 | A1 | 2/2013 | Matsuura et al. | |
| 2013/0142532 | A1 | 6/2013 | Kitagawa et al. | |
| 2013/0164015 | A1* | 6/2013 | Kawai | G03G 15/2039 399/69 |
| 2013/0206745 | A1 | 8/2013 | Tanaka et al. | |
| 2014/0023390 | A1* | 1/2014 | Hirado | G03G 15/205 399/70 |
| 2014/0205307 | A1 | 7/2014 | Tanaka | |
| 2015/0037055 | A1 | 2/2015 | Kitagawa et al. | |

FOREIGN PATENT DOCUMENTS

| | | |
|---|---|---|
| JP | 2012-118487 | 6/2012 |
| JP | 2013-064790 | 4/2013 |

* cited by examiner

IMAGE FORMING APPARATUS

FIELD OF THE INVENTION AND RELATED ART

The present invention relates to an image forming apparatus for forming an image on a sheet. The image forming apparatus may be a copying machine, a printer, a facsimile machine, a multifunction machine having a plurality of functions of these machines, or the like.

In a known image forming apparatus, there is provided an image fixing device for heating a toner image formed on the sheet to fix the toner image on the sheet. Japanese Laid-open Patent Application 2013-64790 discloses a fixing device, in which the toner image on the sheet is heated and pressed by a nip forward between a heating roller and a pressing roller.

When the toner image is fixed using such a fixing device (fixing process), there is a likelihood that dew condensation occurs on the feeding path for the sheet. More particularly, by the fixing process of the fixing device, water vapor is produced from the sheet, and the dew condensation occurs by the water vapor being cooled in the feeding path for the sheet. Such dew condensation occurs as the feeding path is cooled, and for example, when a main switch of the image forming apparatus is actuated first in the morning after the image forming apparatus is kept unactivated last night, the dew condensation may occur if the fixing process is continuously carried out after the actuation of the main switch.

By the dew condensation, water droplets may be deposited on the sheet with the result of image defect. Japanese Laid-open Patent Application 2013-64790 discloses suppression of the production of the dew condensation by warming the feeding path. More particularly, wherein these fixing device, after the heating roller is heated up to the temperature at which the fixing process can be carried out, the execution instructions for the fixing process are waited while keeping the temperature of the heating roller. By doing so, the feeding path is warmed by the heat radiation from the heating roller.

However, when the heat radiation from the heating roller to the feeding path is insufficient, the problem with the dew condensation is not avoidable. More particularly, wherein these fixing apparatus, when the execution instructions for the fixing process are produced immediately after the heating roller this heated up to the fixable temperature, in the first operation in the morning, it is difficult to sufficiently warm the feeding path.

SUMMARY OF THE INVENTION

Accordingly, it is an object of the present invention to provide an image forming apparatus ion which the production of the image defect can be suppressed.

According to an aspect of the present invention, there is provided an image forming apparatus comprising an image forming station for forming a toner image on a sheet; a rotatable heating member and a pressing rotatable member configured to fix the toner image formed by said image forming station by heat and pressure; a contacting and spacing portion configured to contact and space said rotatable heating member and said pressing rotatable member relative to each other; an air feeding portion configured to feed air to cool at lease a part of said pressing rotatable member during a job; a guide portion configured to guide feeding of the sheet having been subjected to an image fixing process; an acquiring portion configured to acquire information relating to the temperature of said guide portion: and an executing portion configured to execute a warming-up process of said rotatable heating member and said pressing rotatable member to raise temperatures of said rotatable heating member and said pressing rotatable member, wherein said executing portion controls said contacting and spacing portion and said air feeding portion so that the air is fed toward said guide portion through between said rotatable heating member and said pressing rotatable member at least in a part of the warming-up process, when the information acquired by said acquiring portion indicates that a temperature of said guide portion is lower than a predetermined temperature when a main voltage source of said image forming apparatus is activated.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the example of the image forming apparatus is a printer using an electrophotographic process.

[Embodiment 1]

(Image Forming Station)

Figure 1:
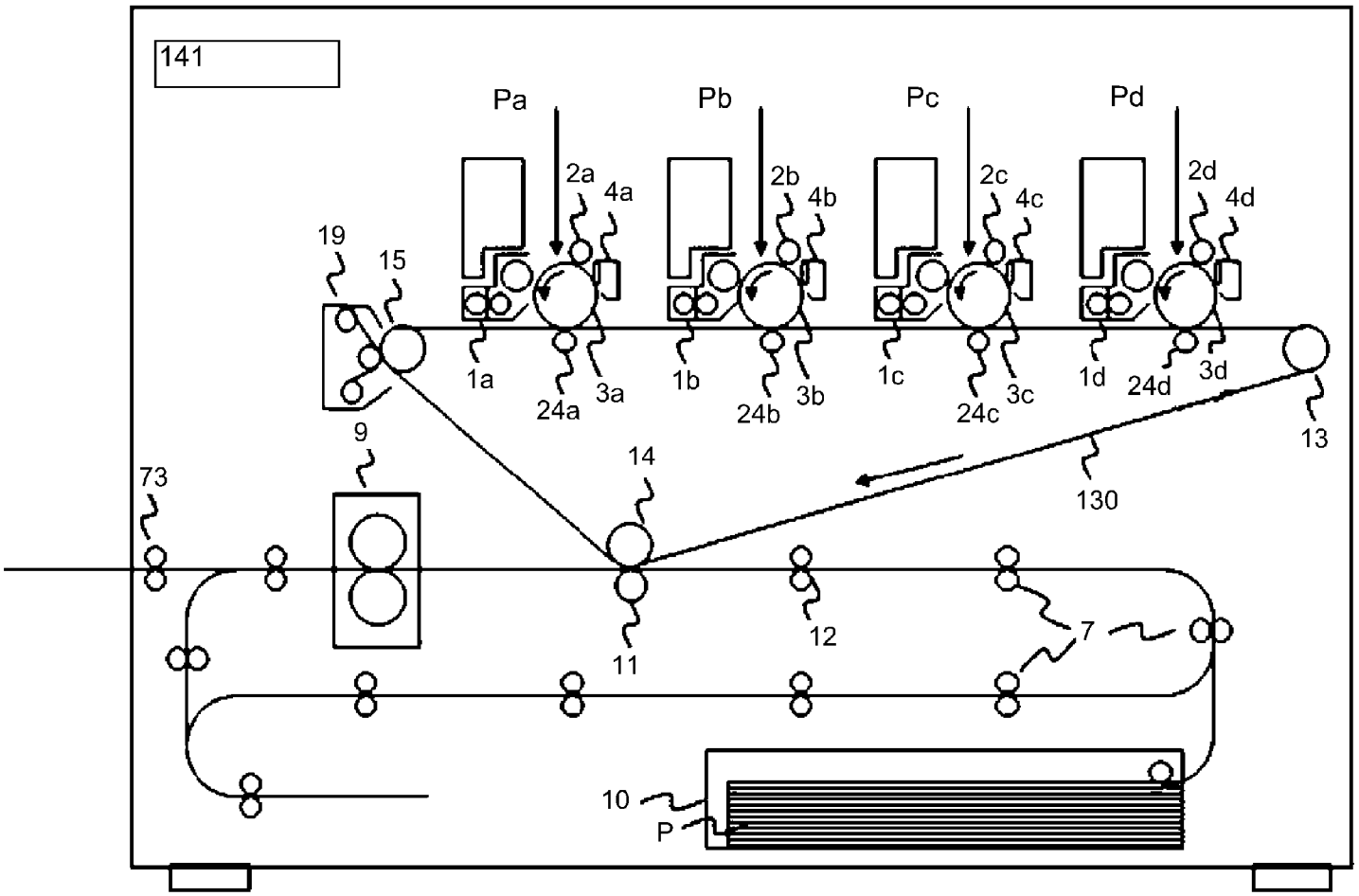
FIG. 1 is a sectional view of an image forming apparatus according to Embodiment 1 of the present invention.

FIG. 1 is a sectional view of the image forming apparatus. As shown in FIG. 1, the image forming apparatus comprises juxtaposed first, second, third and fourth image forming stations Pa, Pb, Pc, Pd. In these image forming stations, different color toner images are formed through latent image formation, development and transfer processes.

The image forming stations Pa, Pb, Pc, Pd include photosensitive drums 3*a*, 3*b*, 3*c*, 3*d* as image bearing members, respectively. On the photosensitive drums 3*a*, 3*b*, 3*c*, 3*d*, respective color toner images are formed. An intermediary transfer member (intermediary transfer belt) 130 is provided adjacent to the photosensitive drums 3*a*, 3*b*, 3*c*, 3*d*. Onto the intermediary transfer member 130, the toner images are primary-transferred from the photosensitive drums 3*a*, 3*b*, 3*c*, 3*d*. The toner images carried on the intermediary transfer member 130 are secondary-transferred onto the sheet P in a secondary transfer portion. The sheet P now carrying the toner images a heated and pressed by the fixing portion (fixing device) 9, so that the toner image fixed on the sheet. Thereafter, the sheet is discharged out of the apparatus.

Around the photosensitive drums 3*a*, 3*b*, 3*c*, 3*d*, drum chargers 2*a*, 2*b*, 2*c*, 2*d*, developing devices 1*a*, 1*b*, 1*c*, 1*d*, primary transfer chargers 24*a*, 24*b*, 24*c*, 24*d* And cleaners 4*a*, 4*b*, 4*c* are provided, respectively. In the upper portion of the apparatus, there are provided unshown exposure device, light source device and polygonal mirrors.

The exposure device forms latent images on the surface of the photosensitive drums 3*a*, 3*b*, 3*c*, 3*d* having been charged by the drum chargers 2*a*, 2*b*, 2*c*, 2*d*, respectively.

More particularly, the drum is scanned by the laser beam emitted from the light source device using a rotational polygonal mirror. The scanning laser beams are condensed and scans the photosensitive drums 3*a*, 3*b*, 3*c*, 3*d* along a generatrix lines thereof, using a fθ lens. By this, latent images are formed on the photosensitive drums 3*a*, 3*b*, 3*c*, 3*d* in accordance with image signals, respectively.

The developing devices 1*a*, 1*b*, 1*c*, 1*d* contain yellow, magenta, cyan and black toner particles as developers, respectively. The developing devices 1*a*, 1*b*, 1*c*, 1*d* develop the latent images on the photosensitive drums 3*a*, 3*b*, 3*c*, 3*d*. That is, the latent images on the photosensitive drums 3*a*, 3*b*, 3*c*, 3*d* are visualized into a yellow toner image, a magenta toner image, a cyan toner image and a black toner image, respectively.

The intermediary transfer member 130 is a member for carrying the toner and is rotated in the direction indicated by the arrow at the peripheral speed which is substantially the same as the peripheral speeds of the photosensitive drum 3*a*, 3*b*, and 3*c*. In the following, the feeding of the toner by the intermediary transfer member 130 in the case of the yellow toner image will be described as an example.

The first color yellow toner image formed on the photosensitive drum 3*a* is fed into the nip formed between the photosensitive drum 3*a* and the intermediary transfer member 130, by the rotation of the photosensitive drum. The intermediary transfer member 130 is supplied with a primary transfer bias voltage, by which an electric field it form, and the yellow toner image it temporarily transferred onto the outer peripheral surface of the intermediary transfer member 130 by the electric field and the pressure of the nip.

Similarly, the second color magenta toner image, the third color cyan toner image and the fourth color black toner image are superimposedly transferred onto the intermediary transfer member 130, sequentially. By this, a synthesized color toner image corresponding to the intended color image is formed on the intermediary transfer member.

The secondary transfer roller 11 is a roller supported in parallel with the intermediary transfer member 130.

It is contacted to the lower surface of the intermediary transfer member 130. The secondary transfer roller 11 is supplied with a desired secondary transfer bias voltage by a secondary transfer bias voltage source. The synthesized color toner image on the intermediary transfer member 130 is transferred onto the sheet P in the following manner. The sheet P fed from the feeding cassette 10 to a contact nip formed between the intermediary transfer member 130 and the secondary transfer roller 11, by the way of the feeding portion 7 and registration rollers 12 a pre-transfer prior guide (unshown). The secondary transfer roller 11 is supplied with a secondary transfer bias voltage from the bias voltage source, by which the synthesized color toner image is transferred onto the sheet P from the intermediary transfer member 130.

The polarity of the secondary transfer bias voltage is opposed to the polarity of the toner charge, and the intensity thereof is adjusted by the controller 141 in accordance with the ambient conditions such as temperature/humidity around the device and the kind of the sheet such as a basis weight and/or surface property. In the printer of this embodiment, a cleaning control for the secondary transfer roller is carried out in the period of sheet interval (the timing in which no sheet passes) in the case of continuous sheet processing, and after the completion of the job. In the cleaning operation, the controller 141 applies to the secondary transfer roller a secondary transfer bias voltage having the same polarity as that of the toner charge, for a predetermined period. By this, the scattered toner and/or the foggy toner deposited on the secondary transfer roller is returned to the intermediary transfer member 130, so that a deterioration of the transferring performance and back side contamination of the sheet can be avoided.

A pair of registration rollers 12 is constituted by a roller of ethylene propylene rubber having a hardness of 40° ASKER-C1 kg and a surface Rz of approx. 20 μm) and a diameter of 16 mm on the back side of the sheet, and a roller of stainless steel having a diameter of 16 mm on the front side of the sheet. The rollers a press contacted to each other at a weight of 1 kg. The rubber roller on the back side is connected with a stepping motor, and the controller 141 controls on the driving of the stepping motor to stop and feed the sheet P by the registration rollers 12.

Thus, the registration rollers 12 once stop the sheet P coming from the feeding portion 7, by the nip formed thereby. By this, the registration rollers correct the inclination of the sheet and also feed the sheet in timed relation with the toner image on the intermediary transfer member 130.

After the primary-transfer, the surfaces of the photosensitive drums 3*a*, 3*b*, 3*c*, 3*d* are cleaned by cleaners 4*a*, 4*b*, 4*c*, respectively. Therefore, the untransferred toner is removed from the surfaces of the photosensitive drums 3*a*, 3*b*, 3*c*, 3*d* to prepare for the next image forming operation. A cleaning web (nonwoven fabric) 19 is contacted to the intermediary transfer member 130 to wipe off the toner, paper dust or the like remaining on the surface of the transfer belt 130.

(Fixing Device)

Figure 3:
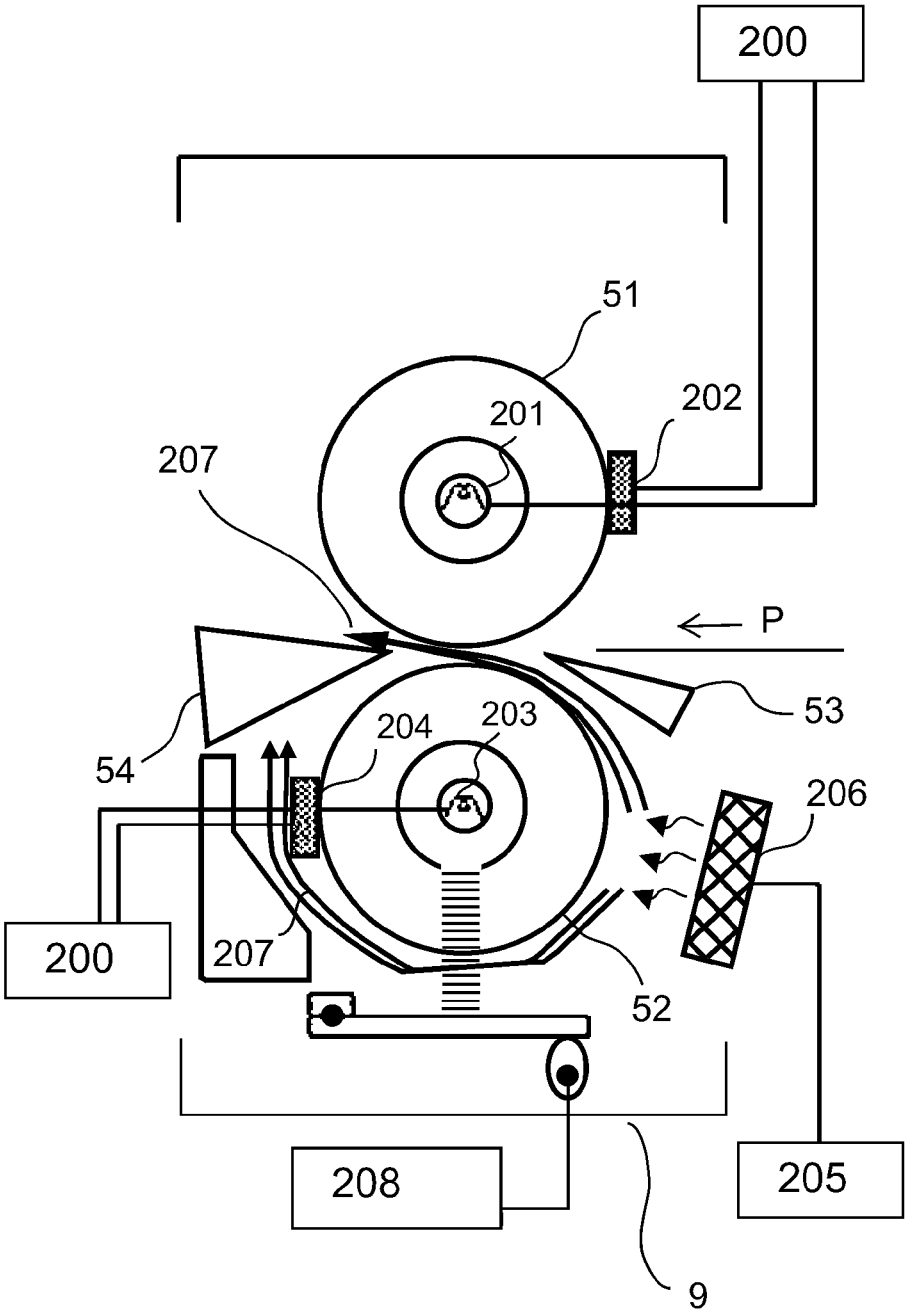
FIG. 3 is a sectional view of a fixing device according to Embodiment 1.

FIG. 3 is a sectional view of the fixing device 9 according to the embodiment. In this embodiment, the fixing device 9 employs two roller as fixing members forming a fixing nip (nip). Of these rollouts, the roller at the image surface side is called a fixing roller 51 which is a first rotatable member (fixing rotatable member), and the roller at the non-image surface side is called pressing roller 52 which is a second rotatable member (pressing rotatable member). The fixing roller 51 and the pressing roller 52 are provided with respective halogen heaters 201, 203 as heating sources.

The sheet P is guided from the right side toward left (FIG. 3) by an inlet feeding guide 53 and is subjected to heating and pressing processing by the nip. The fixing roller 51 is rotatable in the clockwise direction (FIG. 3), and the pressing roller 52 is rotatable in the counterclockwise direction (FIG. 3) to nip and feed the sheet P. In the feeding process, the toner image is fixed on the sheet P. The sheet P having passed through the nip is guided by the way of a discharging feeding guide 54 provided downstream of the nip with respect to the sheet feeding direction to a discharging unit provided downstream of the fixing device 9 with respect to the sheet feeding direction. Thus, the feeding guide 54 functions as a guide portion for guiding the sheet having been subjected to the fixing process in the nip.

The fixing roller 51 of this embodiment includes a cylindrical core metal made of steel and having an outer diameter of ϕ72 mm, a silicone rubber elastic layer having a thickness of 4 mm on the core metal, and a PFA tube having a thickness of 30 μm as a parting layer on the elastic layer. On the other hand, the pressing roller 52 of this embodiment a cylindrical core metal made of steel and having an outer diameter of ϕ76 mm, a silicone rubber elastic layer having a thickness of 2 mm on the core metal, and a PFA tube having a thickness of 30 μm as a parting layer on the elastic layer.

In this embodiment, the fixing device is a roller equation fixing device using the fixing roller 51 and the pressing roller 52, but the present invention is not limited to the fixing device of this type. For example, the use can be made with an endless belt for the fixing member for forming the nip for the purpose of accomplishing high speed printing, by making the nip wider. Furthermore, the fixing device is not limited to the device using the endless belt for the fixing rotatable member (first rotatable member) corresponding to the fixing roller 51 of this embodiment. For example, the pressing rotatable member (second rotatable member) corresponding to the pressing roller 52 of this embodiment may be an endless belt. As described in the foregoing, the rotatable heating member and the pressing rotatable member functions to fix the toner image on the sheet by the heat and pressure. The fixing rotatable member and the pressing rotatable member may be endless belts, respectively.

In this embodiment, pressing roller 52 is pressed against the fixing roller 51, but the fixing roller 51 may be pressed against the pressing roller 52.

Inside the fixing roller 51, there is provided a halogen heater 201 (900 W heater in this embodiment) as the heating source. A temperature detecting portion 202 such as a thermister is contacted at a longitudinal in central portion upstream of the fixing roller 51 with respect to the sheet feeding direction. A temperature control portion 200 controls electric power supply to the halogen heater 201 on the basis of an output of the temperature detecting portion 202. A surface temperature of the fixing roller 51 is controlled to be maintained at a target temperature, in the fixing device 9. The temperature detecting portion 202 is preferably disposed upstream of the nip with respect to the rotational moving direction of the fixing roller 51. In this embodiment, the target temperature of the fixing roller 51 during the printing operation is 160 degree C.

Similarly, inside the pressing roller 52, there is provided a halogen heater 203 (600 W heater in this embodiment). A temperature detecting portion 204 such as a thermister is contacted to the pressing roller 52 at the longitudinal central portion. A temperature control portion 200 controls electric power supply to the halogen heater 203 on the basis of an output of the temperature detecting portion 204. A surface temperature of the fixing roller 51 is controlled to be maintained at a target temperature, in the fixing device 9. The temperature detecting portion 204 preferably disposed upstream of the nip with respect to the rotational direction of the pressing roller 52. In this embodiment, the target temperature of the pressing roller 52 during the printing operation is 100 degree C.

The heating source (heating portion) is not limited to a halogen heater, but an induction heating device provided inside or outside of the fixing member may be used to heat the metal portion of the fixing member.

(Contacting and Spacing Portion)

The fixing device 9 of this embodiment is provided with a contacting and spacing portion 208 for pressing the pressing roller 52 against the fixing roller 51 and spacing the pressing roller 52 from the fixing roller 51. The contacting and spacing portion 208 of this embodiment is a mechanism including a motor and a cam. The contacting and spacing portion 208 controls the state of nip (pressing and spacing) by controlling the position of the frame supporting shaft portions of the pressing roller 52 by a stop position of the cam. The contacting and spacing portion 208 of the fixing device 9 of this embodiment is control to place the nip in the spacing position during a first-warming-up-control-in-the-morning (warming up period) and during print stand-by control, and to place the nip in the nipping position only during the printing operation.

By such a spacing state of the nip, an excessive temperature rise of the surface temperature of the pressing roller 52 by a post-rotating operation or the like after the printing operation can be avoided. In addition, the wearing of the fixing roller 51 and the pressing roller 52 can be reduced, so that the lifetimes of them can be prolonged. As will be described hereinafter, in the case of heating the feeding guide 54, the nip is in the spacing state in the first-warming-up-control-in-the-morning.

(Air Feeding Portion)

FIG. 3 is a sectional view of a fixing device according to Embodiment 1. As shown in FIG. 3, the fixing device is provided with an air feeding portion 206 for cooling at least a part of the heated pressing roller 52. The air feeding portion 206 in this embodiment includes a fan, and a cooling controller 205 supplies electric power to the fan to feed the air by the air feeding portion 206.

The fan feeds the air having a temperature close to a normal temperature to the pressing roller 52 which is the object to be cooled to lower the surface temperature of the pressing roller 52 which has been raised as a result of the printing operation. It is preferable that the air feeding portion 206 disposed upstream of the nip with respect to the sheet feeding direction to feed the air toward the pressing roller 52. In other words, it is preferable that an air feeding plane (air feeding opening) of the fan of the air feeding portion 206 is directed toward the nip from an upstream side of the nip with respect to the sheet feeding direction. The air feeding portion 206 of this embodiment is disposed upstream of the pressing roller 52 with respect to the sheet feeding direction below the sheet feeding path.

The air feeding portion 206 is operated when switching from a thick sheet to a thin sheet during the execution of a basis weight mixed print job, for example (the surface temperature of the pressing roller 52 is to be lowered. Also, it is operated when the electric power supply from the halogen heater 201 overshoots to raise the temperature of the pressing roller 52 during the post-rotation after the printing, and in such a case, the temperature of the pressing roller 52 can be quickly lowered to a predetermined stand-by temperature. In such cases, the execution of the job is interrupted, the air feeding portion 206 feeds the air toward the pressing roller in the state that the fixing roller 51 and the pressing roller 52 are spaced from each other. In the description, the period in which the execution of the job is interrupted and the fixing process operation of the fixing device is interrupted is also called "during the job".

The fixing device may feed the air during the execution of the fixing process operation by the air feeding portion 206. In this case, it is preferable that the air feeding direction of the air feeding portion 206 it such that the air impinges substantially only on the lower surface of the fixing roller 52 so as not to obstruct the feeding of the sheet.

As will be described hereinafter, in this embodiment, the air feeding portion 206 is operated to warm the feeding guide 54 during the first-warming-up-control-in-the-morning. More particularly, the air fed from the air feeding portion 206 and then warmed by the heated pressing roller 52 passes between the fixing roller 51 and the pressing roller 52 which are spaced from each other to the feeding guide 54. By this, the feeding guide 54 can be warmed by the warm air flow.

In the fixing device 9 of this embodiment, when the temperature of the fixing member is low at the time of actuation of the main voltage source of the image forming apparatus, a preliminary warming-up process operation is carried out in order to accumulate heat in the fixing member. In the ON-state of the main voltage source of the image forming apparatus, each structure including the controller 141 is operable.

In the OFF-state of the main voltage source of the image forming apparatus, the controller 141 is not operable.

A fundamental flow of operation of the first-warming-up-control-in-the-morning in this embodiment will be described. When the detected temperature of the fixing roller 51 at the time of the voltage source activation of the printer is not higher than a predetermined temperature (50 degree C. for example), the temperature control portion 200 controls the heaters 201, 203 to execute 4 minute warming-up process. The temperature control portion 200 functions as an executing portion for executing the warming-up process for the fixing roller 51 and the pressing roller 52 so as to raise the temperatures thereof.

After the completion of the pre-heating (warming-up process) for the fixing roller 51 and the pressing roller 52, the fixing device 9 shifts to a stand-by in which it waits for the execution of the printing while keeping the fixing roller 51 and the pressing roller 52 in a warm state. In this embodiment, the target temperatures of the fixing roller 51 and the pressing roller 52 during the first-warming-up-control-in-the-morning and stand-by control are 160 degree C. and 100 degree C.

(Continuous Printing)

Figure 2:
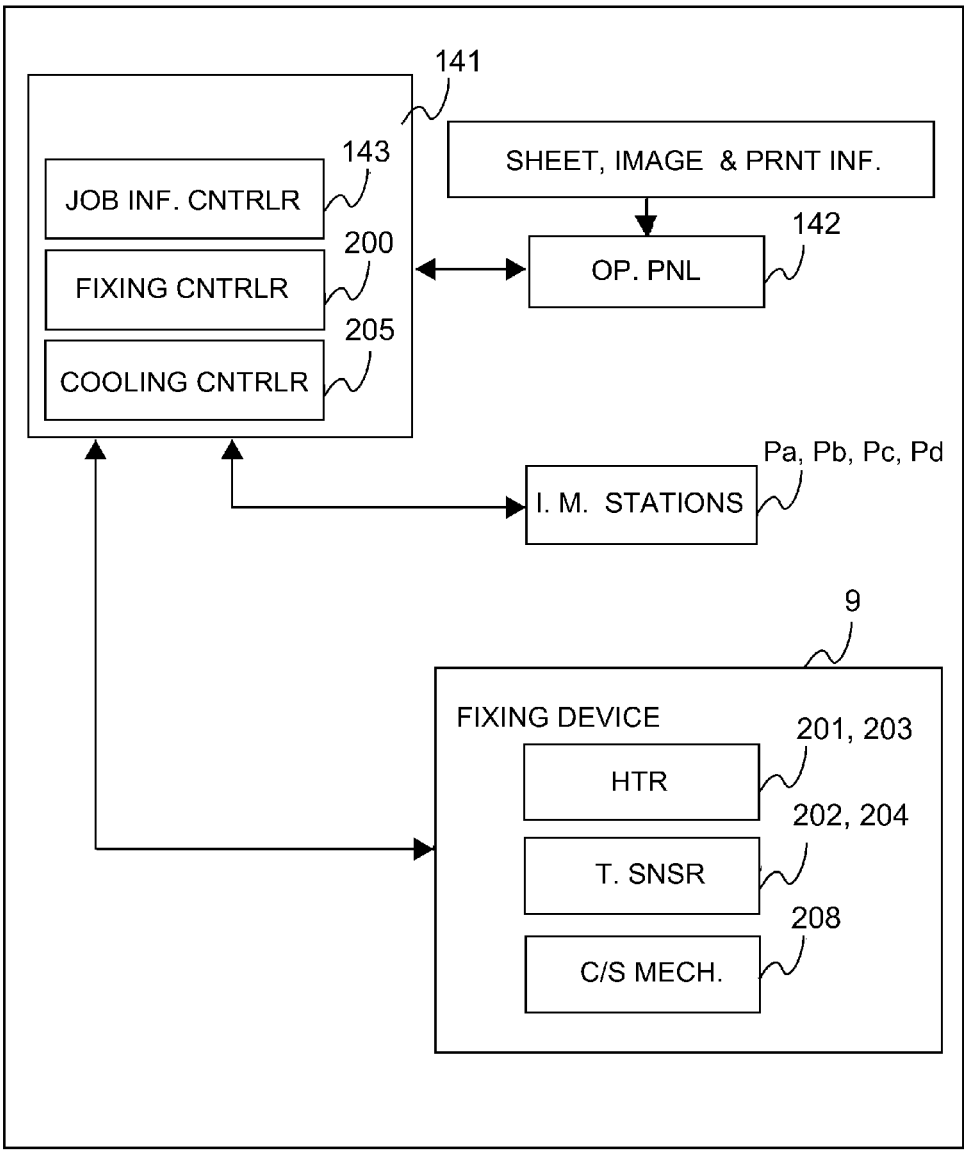
FIG. 2 is a block diagram of the image forming apparatus according to Embodiment 1.

The image forming apparatus carries out continuous printing operation by repeating the feeding-registration-imaging-fixing-discharging operation using the above-described structures. The image forming apparatus of this embodiment is capable of printing on A4 size sheets P at the speed of 80 sheets per minute. As shown in FIG. 2, the image forming apparatus includes the controller 141 which is a control circuit including CPU and so on for executing various controls, and an operating portion 142 such as an operation panel which is an interface for the user to access the apparatus.

The controller 141 monitors and controls various parts of the apparatus to control commands between units to govern the entirety of the image forming apparatus. As shown in FIG. 2, the controller 141 has functions of job information storing portion 143, a temperature control portion (fixing temperature controller) 200 and a cooling controller (fixing cooling controller) 205. The job information storing portion 143 is a memory for storing information of the job. The controller 141 reads out the information stored in the job information storing portion 143 and use it as parameters for controlling operations of various parts of the apparatus.

In the operating portion 142, the fundamental print job information can be set, and detail settings such as mixed stacking print can be carried out. The inputting and/or various settings of the print job information can be carried out by an outer information terminal such as a personal computer connected with the controller 141.

(Specific Operations)

Figure 4:
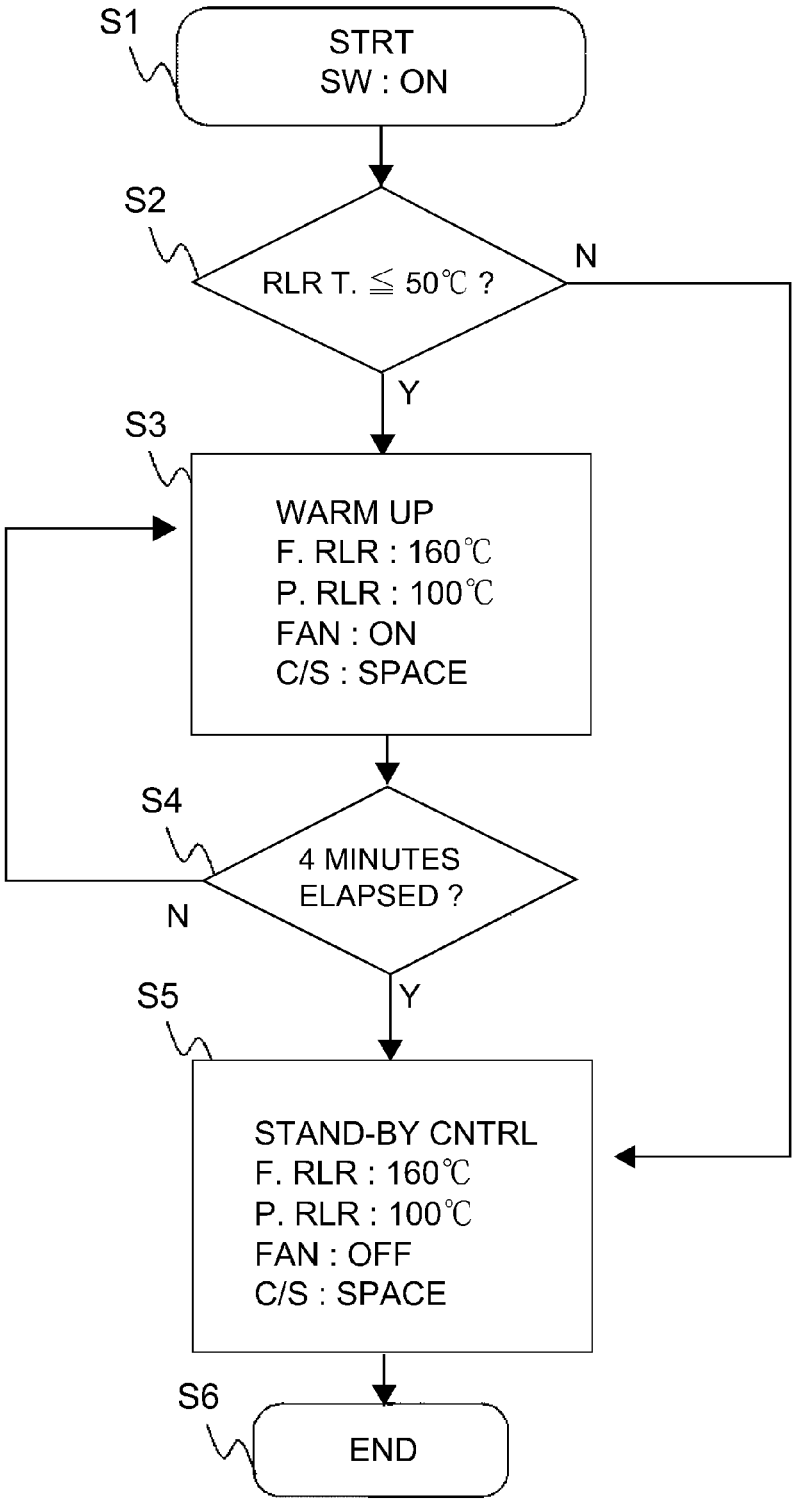
FIG. 4 is a flow chart of the operation of the fixing device according to Embodiment 1.

Specific operations of the image shape device will be described. FIG. 4 is a flow chart of the control for the warming-up process of the image forming apparatus in the case that the main voltage source is activated in the first-in-the-morning state (after one night rest in the power OFF-state) or in the case that the image forming apparatus is restored from a long term sleeping state for saving energy. When the main voltage source of the image forming apparatus is activated (step S1), the controller 141 discriminates whether to execute the first-warming-up-control-in-the-morning. More particularly, when the fixing device 9 is cool, the controller 141 executes the first-warming-up-control-in-the-morning, and when the fixing device 9 is not cool, the controller 141 does not execute the first-warming-up-control-in-the-morning. The controller 141 discriminates whether the fixing device 9 is cool or not on the basis of the output of the temperature detecting portion 202 of the fixing roller 51. Or, the discrimination is made as to whether the temperature around the feeding guide 54 is low or not. That is, the controller 141 functions as an acquiring portion for acquiring the information corresponding to the temperature of the feeding guide 54 on the basis of the output of the temperature detecting portion 202. A temperature detecting portion such as thermister may be provided on the feeding guide 54 to directly detect temperature of the feeding guide 54.

When the temperature of the fixing roller 51 is not higher than 50 degree C., the controller 141 discriminates that the fixing device 9 is cool and carries out the first-warming-up-control-in-the-morning (step S3). When the temperature of the fixing roller 51 exceeds 50 degree C., the controller 141 discriminates that the fixing device 9 is warm. The controller 141 does not operate the air feeding portion 206 and raises the temperatures of the fixing roller 51 and the pressing roller 52 up to the respective target temperatures (warming-up) (step S5). That is, the controller 141 executes a print stand-by control to await the input of a job. The cases in which the temperature of the feeding guide 54 in the first-in-the-morning state is higher than a predetermined temperature, namely the cases in which the main voltage source of the image forming apparatus is actuated in the state that the fixing device 9 is warm are as follows. Namely, it is the case that the image forming apparatus is interrupted for a short period for a sheet jam clearance or device maintenance or the like immediately after the image forming apparatus is warmed by execution of a continuous job.

When the predetermined conditions are reached, the controller 141 finishes the first-warming-up-control-in-the-morning. In this embodiment, the elapse of time of the first-warming-up-control-in-the-morning is counted, and the control is finished at the time when a predetermined time elapses from the start of the heating temperature control of the fixing member. The parameters used in the first-warming-up-control-in-the-morning in this embodiment will be described. The target temperature of the fixing roller 51 is 160 degree C., the target temperature of the pressing roller 52 is 100 degree C., the air feeding portion 206 is always kept on, and the first-warming-up-in-the-morning period is 4 minutes (step S3).

In the step S3, the controller 141 spaces the fixing roller 51 and the pressing roller 52 from each other using the contacting and spacing portion 208. The controller 141 actuates the air feeding portion 206 to feed the air. The air fed by the air feeding portion 206 is warmed by the pressing roller 52, and the thus warm air reaches the feeding guide 54 through the gap between the fixing roller 51 and the pressing roller 52 which are spaced from each other. By this, the temperature of the feeding guide 54 is raised by the warm air. In other words, the feeding guide 54 is warmed by executing the air feeding process of the air feeding portion in the first-warming-up-in-the-morning operation.

In the above-described the manner, wherein the output of the temperature detecting portion 202 indicates that the temperature of the feeding guide 54 is lower than the predetermined temperature, the controller 141 controls the contacting and spacing portion 208 and the air feeding portion 206 so that the air is fed toward the feeding guide 54 through between the fixing roller 51 and the pressing roller 52 in the first-warming-up-control-in-the-morning.

With the above-described structures, the air supplied by the air feeding portion 206 flows through a cooling air path 207 in FIG. 3. That is, the warm air having passed by the surface pressing roller 52 and warmed thereby reaches the feeding guide 54 through between the fixing roller 51 and the pressing roller 52. Therefore, the warm air can be supplied efficiently to the feeding surface of the feeding guide 54. The air fed toward the pressing roller 52 is warmed also by the fixing roller 51. Therefore, the efficient warming of the feeding guide 54 can be accomplished. It is possible to supply the warm air to the feeding guide 54 without spacing the fixing roller 51 and the pressing roller 52 from each other. However, in the state that the fixing roller 51 and the pressing roller 52 contact to each other, the air from the air feeding portion 206 travels around the lower part of the pressing roller, and it is difficult to efficiently warm the feeding surface of the feeding guide 54. For this reason, when the feeding guide 54 is heated by the air from the air feeding portion 206, it is preferable to space the pressing roller 52 and the fixing roller 51 from each other as in this embodiment.

When the predetermined time (4 minutes) elapses from the start of the first-warming-up-control-in-the-morning, the controller 141 finishes the first-warming-up-control-in-the-morning (step S4). Thereafter, the controller 141 carries out the print stand-by control (step S5). That is, the controller 141 completes a series of the operations (step S6). In this embodiment, in the print stand-by control, the target temperatures of the fixing roller 51 is 160 degree C., and the target temperature of the pressing roller 52 is 100 degree C., similarly to those for the first-warming-up-control-in-the-morning.

In the foregoing description, the discrimination without or not the fixing device 9 is cool (whether the feeding guide 54 is cool) is made by the controller 141 on the basis of the output of the temperature detecting portion 202. However, the discrimination method for the first-in-the-morning state is not limited to this example. For example, a counter may be provided to measure the OFF-state period of the voltage source (main voltage source) of the image forming apparatus. In this case, the fixing device 9 discriminates the first-in-the-morning state when the OFF-state period is longer than a predetermined period. In this case, when the main voltage source of the image forming apparatus is activated in the state that the OFF-state period is longer than the predetermined period, the controller 141 carries out the first-warming-up-control-in-the-morning.

In the foregoing description, the target temperatures for the first-warming-up-control-in-the-morning and the target temperatures for the print stand-by are the same, but this is not inevitable. For example, when the fixing device employs a thermal capacity heating member with which the temperature quickly changes, the target temperatures for the first-warming-up-control-in-the-morning and the target temperatures for the print stand-by may be made different from each other.

Figure 5:
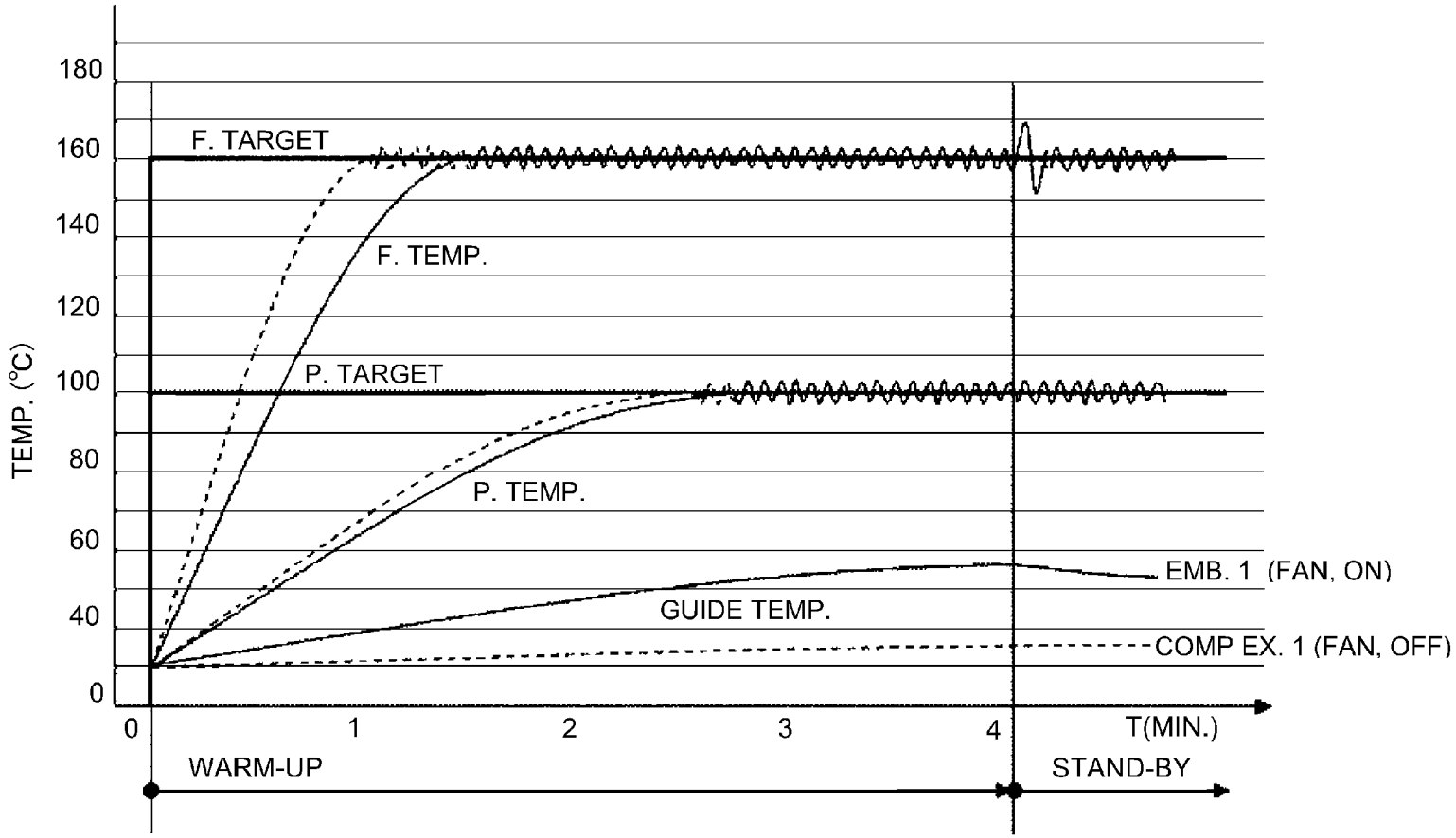
FIG. 5 shows a change of the temperature of the fixing device according to Embodiment 1.

FIG. 5 shows the changes of the temperatures of the fixing roller 51, the pressing roller 52 and the feeding guide 54 during the first-warming-up-control-in-the-morning. The solid lines are temperature changes in this embodiment, and broken lines are temperature changes of a conventional example. As will be understood from FIG. 5, the fixing roller 51, the pressing roller 52 and the feeding guide 54 having the same temperature as the ambient temperature (approx. 20 degree C.) are warmed up with the progress of the first-warming-up-control-in-the-morning. Also, as will be understood from FIG. 5, at the time of the completion of the first-warming-up-control-in-the-morning, that is, 4 minutes after the start of the first-warming-up-control-in-the-morning (shifting to the print stand-by control), the temperatures of the fixing roller 51 and the pressing roller 52 have reached the target temperatures, and the temperature of the feeding guide 54 has reached approx. 55 degree C.

On the contrary, in the case of the conventional example (air feeding portion 206 it's not actuated during the warming-up operation) indicated by the broken lines, the temperature of the feeding guide 54 at the time of completion of the warming-up is as low as approx. 30 degree C. Thus, wherein the first-warming-up-control-in-the-morning of this embodiment, as compared with the warming-up control of the conventional example, the temperature of the feeding guide 54 can be raised more by not less than 20 degree C.

According to the warming-up control of this embodiment described in the foregoing, the temperature of the feeding guide 54 at the time of the completion of the warming-up operation (at the time of the shifting to the stand-by) is not lower than 50 degree C. Therefore, when the printing operation is carried out immediately after the completion of the first-warming-up-control-in-the-morning, the water vapor which is produced from the sheet P passing through the nip is not quenched by the feeding guide or the like. Therefore, with the fixing device 9, the dew condensation of the water vapor does not tend to occur on the feeding guide 54, and therefore, the production of the image defect due to the dew condensation can be suppressed.

[Embodiment 2]

Figure 6:
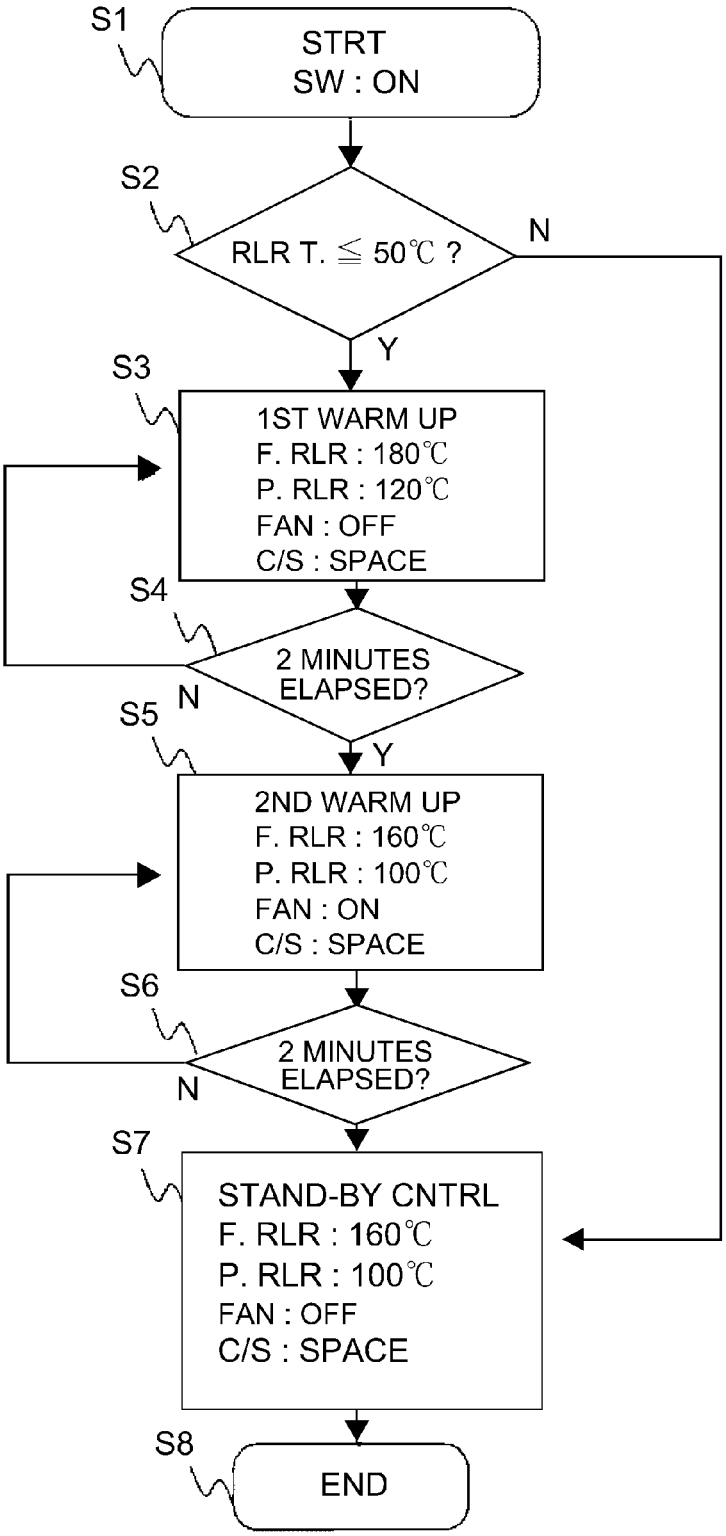
FIG. 6 is a flow chart of operation of an image fixing device according to Embodiment 2.

A fixing device 9 of Embodiment 2 will be described. In Embodiment 1, the air feeding portion 206 is actuated at the beginning of the first-warming-up-control-in-the-morning. On the other hand, in Embodiment 2, the air feeding portion 206 is actuated partway of the first-warming-up-control-in-the-morning. FIG. 6 is a flow chart of a first-warming-up-control-in-the-morning according to Embodiment 2 of the present invention. In the first-warming-up-control-in-the-morning of this embodiment, a first warming-up operation and then a second warming-up operation are carried out. The first warming-up is carried out for 2 minutes, and the second warming-up is carried out for 2 minutes (4 minutes in total).

The flow of the warming-up control according to Embodiment 2 will be described in detail. When the main voltage source of the image forming apparatus is activated (step S1), the temperature detecting portion 202 detects the temperature of the fixing roller 51. The controller 141 discriminates whether to carry out the warming-up control, on the basis of the output of the temperature detecting portion 202 (step S2). In this embodiment, the controller 141 carries out a one warming-up control in the morning if the temperature of the fixing roller 51 is higher than 50 degree C. If temperature of the fixing roller 51 it not higher than 50 degree C., the print stand-by control is carried out.

When the warming-up control is to be carried out, the controller 141 first effects a first warming-up operation (step S3). In the first warming-up operation, the target temperature of the fixing roller 51 is 180 degree C., the target temperature of the pressing roller 52 is 120 degree C., and the air feeding portion is not actuated. In this embodiment, the target temperatures are higher than those in Embodiment 1. As is different from the foregoing embodiment, the air feeding portion 206 is not actuated. By this, the heating and heat accumulation of the fixing members can be effected efficiently. That is, the temperature rise of the fixing members in this embodiment is quick.

In this embodiment, the controller 141 executes the temperature rise process for the fixing members prior to the heating of the guiding member 54 using the air feeding process. More particularly, the contacting and spacing portion 208 keeps the spacing state between the fixing roller 51 and the pressing roller 52, and raises the temperatures of the fixing roller 51 and the pressing roller 52 by the heaters 201, 203 without operating the air feeding portion 208.

When a predetermined time (2 minutes in this embodiment) the elapses (step S4), the controller 141 carries out a second warming-up operation. In the second warming-up, the controller 141 changes the target temperatures to those for the print stand-by state (160 degree C. for fixing roller 160 degree C., and 100 degree C. for pressing roller), and actuates the air feeding portion 206 (step S5). When a predetermined time (2 minutes in this embodiment) after the start of the second warming-up, that is, at the time of the completion of the second warming-up (step S6), the state of the apparatus is shifted to the print stand-by control state, in which the air feeding portion 206 is Off (step S7).

Figure 7:
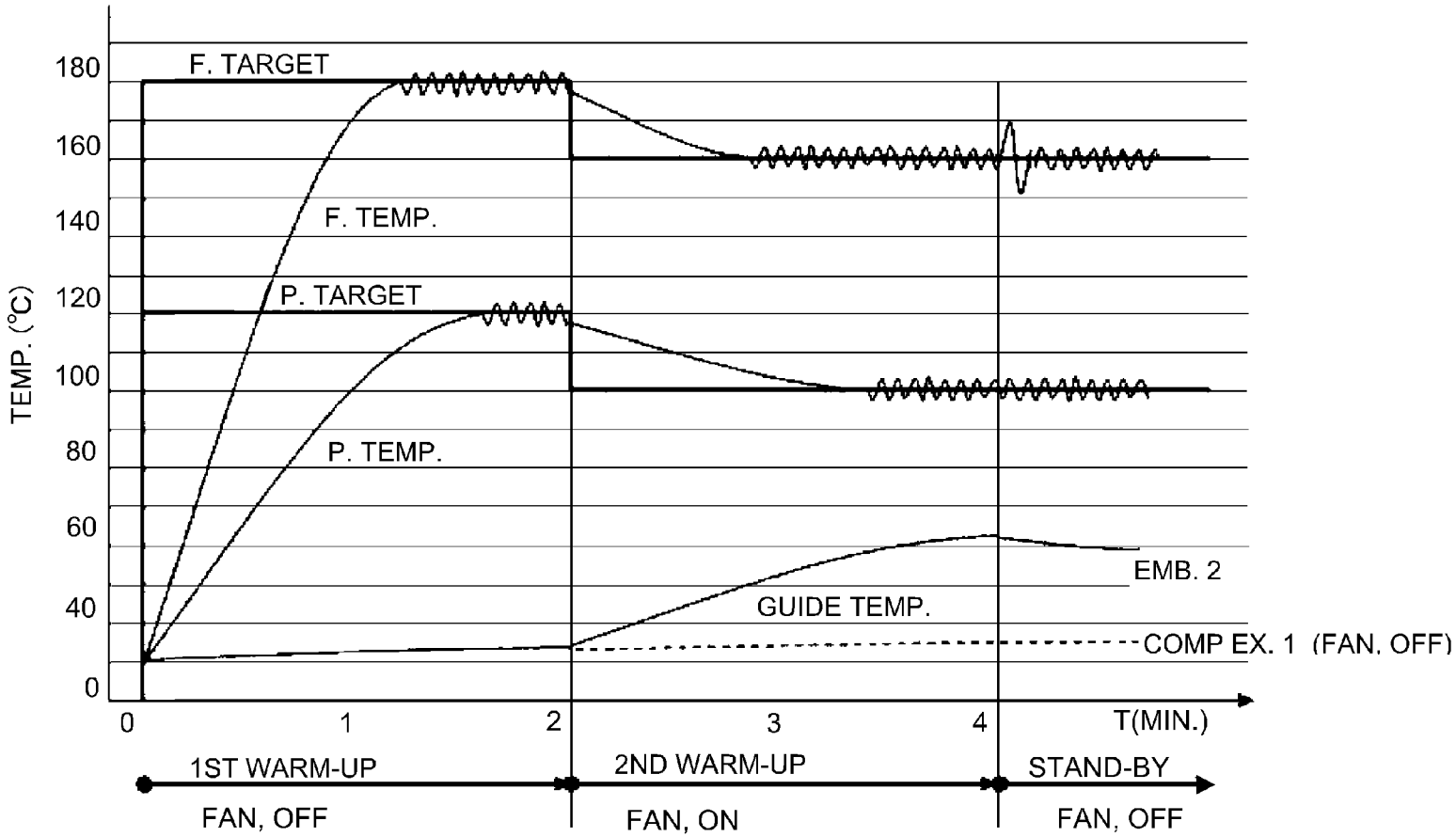
FIG. 7 shows a change of the temperature of the fixing device according to Embodiment 2.

As will be understood from FIG. 7 showing the changes of the temperatures in this embodiment, the heat accumulation of the fixing members is more than that in the first embodiment because of the higher settings of the target temperatures in the first warming-up operation. In the second warming-up operation, the feeding guide 54 is heated by the air feeding to the pressing roller 52. As will be understood from FIG. 5, at this time, the feeding guide 54 is heated to more efficiently in this embodiment than in Embodiment 1. In this embodiment, it is preferable to set the target temperatures of the fixing members in the warming-up control at levels higher than those in the second warming-up operation and the stand-by control operation. However, the target temperatures in the second warming-up operation may be different from the target temperatures in the print stand-by control operation.

More particularly, when the temperature of the feeding guide 54 is lower than a predetermined temperature, the controller 141 actuate the air feeding portion after the temperature of the pressing rotatable member rises up to a first temperature, in at least a part of the warming-up process operation.

The controller 141 maintains the temperature of the pressing rotatable member at a second temperature lower than the first temperature in the period from the completion of the warming-up process operation to the start of the fixing process operation.

When the fixing device 9 has a thermal capacity with which the temperature change is quick, the control may be carried out using the following parameters.

That is, the parameters can be selected so as to satisfy the target temperatures for the first warming-up are higher than the target temperatures for the second warming-up, which is higher than the target temperature for the stand-by state. When the temperature change by the cooling of the air feeding portion 206 is slow, the control may use the following parameters. That is the target temperatures are set to satisfy that the target temperatures for the first warming-up operation is higher than the target temperatures for the stand-by state, and the heaters 201, 203 are the activated in the second warming-up operation.

According to the above-described embodiments, the temperatures of the feeding guide 54 can be raised to such an extent that no dew condensation occurs in the execution of the fixing process, by the first-warming-up-control-in-the-morning. Therefore, the image defect and/or improper feeding attributable to the dew condensation can be suppressed.

MODIFIED EXAMPLE

The present invention is not limited to the above-described embodiments, but various modifications can be made within the present invention.

Modified Example 1

In the foregoing embodiments, a halogen heater and an excitation coil (induction heating) are used, but these examples are not restrictive to the present invention. For example, an endless belt (film) as the fixing member may directly generate heat by electric power supply.

Modified Example 2

In the foregoing embodiments, the fixing roller is opposed to an opposing member which is a pressing rotatable member (pressing roller as the second rotatable member) rotatable together with the fixing rotatable member (fixing roller as the first rotatable member), but the opposing member is not limited to such examples. For example, it may be a pressing pad in the form of a flat plate-like.

Modified Example 3

In the foregoing embodiments, the sheet (recording material) has been a sheet of paper, but this is not restrictive to the present invention. The sheet may be any if a toner image can be formed by the image forming apparatus. It may be a regular or irregular sheet of paper, thick sheet of paper, thin sheet of paper, envelope, post card, seal, resin material sheet, OHP sheet, glossy sheet of paper and so on. In the foregoing description of the embodiments, "feeding the sheet", "discharging the sheet" or the like are used, but they do not mean that the sheet is restricted to a sheet of paper.

Modified Example 4

In the foregoing embodiments, the fixing device is used for fixing the unfixed toner image on the sheet, but the present invention is applicable to a device for changing a glossiness property by heating and pressing a temporarily fixed image on the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-104289 filed on May 20, 2014, which is hereby incorporated by reference herein in its entirety.

What is claimed is:

1. An image forming apparatus comprising:

an image forming portion configured to form a toner image on a sheet;

first and second rotatable members configured to form a nip for heating the toner image on the sheet therebetween;

a guiding portion provided adjacent to the nip and configured to guide the sheet passing through the nip;

an executing portion configured to execute a warm-up process to raise temperature of said first and second rotatable members, which are spaced from each other; and an air blowing portion configured to blow air toward said guiding portion through a portion between said first and second rotatable member which are spaced from each other to heat said guiding portion during at least one time period of the warm-up process.

2. An apparatus according to claim 1, wherein said first rotatable member is disposed so as to contact the toner image on the sheet, and wherein said executing portion executes the warm-up process to raise the temperature of said first rotatable member up to a first target temperature and raise the temperature of said second rotatable member up to a second target temperature which is lower than the first target temperature.

3. An apparatus according to claim 2, wherein said air blowing portion starts blowing the air when the temperature of said first rotatable member is raised up to a predetermined temperature which is lower than the second target temperature.

4. An apparatus according to claim 2, wherein said air blowing proportion starts blowing the air when the temperature of said second rotatable member is a raised up to a predetermined temperature which is lower than the second target temperature.

5. An apparatus according to claim 2, wherein said air blowing portion starts blowing the air when the elapsed time from a start of the warm-up process reaches a predetermined time.

6. An apparatus according to claim 2, wherein said air blowing portion blows the air toward said second rotatable member to cool said second rotatable member during a job.

7. An apparatus according to claim 1, wherein said executing portion executes the warm-up process when a main voltage source of said apparatus is activated.

8. An apparatus according to claim 7, wherein said air blowing portion does not blow the air during the warm-up process in the case that the temperature of said first rotatable member is higher than a predetermined temperature when the main voltage source of said apparatus is activated.

9. an apparatus according to claim 1, wherein said blowing portion is disposed at a position upstream of the nip in a sheet conveying direction.

* * * * *